United States Patent [19]

Michalon

[11] 4,057,017

[45] Nov. 8, 1977

[54] CONTINUOUS TRANSPORT SYSTEM, IN PARTICULAR FOR PUBLIC TRANSPORT

[75] Inventor: Daniel Michalon, Saint Etienne, France

[73] Assignee: Centre Stephanois de Recherches Mecaniques Hydromecanique et Frottement, France

[21] Appl. No.: 658,009

[22] Filed: Feb. 13, 1976

[30] Foreign Application Priority Data

| | | |
|---|---|---|
| Feb. 13, 1975 | France | 75.05206 |
| Feb. 3, 1976 | France | 76.03543 |
| Feb. 3, 1976 | France | 76.03544 |

[51] Int. Cl.[2] ..... B61K 1/00

[52] U.S. Cl. ..... 104/20; 104/18; 104/25; 104/88; 104/89; 104/96; 198/680; 214/42 R

[58] Field of Search ..... 104/18, 20, 25, 88, 104/89, 96, 147 R, 165, 172 R, 172 B, 172 BT, 172 S, 130; 214/42 R, 43; 198/324, 472, 473, 678, 680, 648, 580

[56] References Cited

U.S. PATENT DOCUMENTS

| | | | |
|---|---|---|---|
| 2,868,139 | 1/1959 | Klamp | 104/88 |
| 2,918,021 | 12/1959 | Burrows | 104/172 R |
| 3,051,096 | 8/1962 | Walsh et al. | 104/96 X |
| 3,407,751 | 10/1968 | Orwin | 104/172 BT |
| 3,648,618 | 3/1972 | Pierson et al. | 104/172 BT X |
| 3,893,397 | 7/1975 | Gayot | 104/18 |
| 3,929,076 | 12/1975 | McRae, Jr. et al. | 104/18 X |
| 3,987,734 | 10/1976 | Horn | 104/20 X |

FOREIGN PATENT DOCUMENTS

| | | | |
|---|---|---|---|
| 1,177,505 | 4/1959 | France | 198/680 |

*Primary Examiner*—Robert J. Spar
*Assistant Examiner*—Randolph A. Reese
*Attorney, Agent, or Firm*—Irving M. Weiner; Pamela S. Austin

[57] ABSTRACT

A continuous transport system for serving an urban region, for example, for public transport. The transport system includes at least one looped main track which cooperates with at least one station track. The main track conveys platforms with removable cabins disposed thereon at a constant speed, and the cabins are adapted to be transferred to similar platforms provided on the station track. The station track varies the speed of the cabins therealong to permit embarkation and disembarkation therefrom.

27 Claims, 23 Drawing Figures

CONTINUOUS TRANSPORT SYSTEM, IN PARTICULAR FOR PUBLIC TRANSPORT

The present invention relates to a continuous transport system, in particular for public transport.

BACKGROUND OF THE INVENTION

A public transport line is generally provided to serve a whole series of stations. Each vehicle on the line covers a fixed route stopping at each station in succession for the passengers to get in and alight. The drawback of lines of this type is that they lead to journeys, whose time it is difficult to reduce beyond certain limits. The travelling speed of the vehicles may be increased slightly, but it is impossible to avoid the length of stopping times at stations. For a passenger making a journey of several stations, the time lost in useless stops becomes considerable.

Continuous line transport systems are known, comprising one track or line, along which carriages which never stop travel constantly. The transportation capacity of the line is thus increased. However, to allow the passengers to embark or disembark at the stations, it is necessary to vary the travelling speed of the carriages: each carriage travels at high speed between two stations, it decelerates when it arrives at a station, passes through this station at reduced speed to allow embarkation, then once more reaccelerates to reach the high speed, which it maintains until the next station.

This type of transport, considered to be the transport means of the future, at present encounters difficulties which are mainly due to two reasons:

- non-coherence of the load and of the infra-structure,
- the necessity of providing complex control systems.

Non-coherence is linked with the fact that the vehicles move closer together when they decelerate, whereas they move apart when they reaccelerate, such that the relative spacing of vehicles travelling at high speed on the main track is much greater than that which would be permitted by the infra-structure. In fact, this relative spacing of the vehicles depends on the minimum separation of the vehicles in the low speed embarkation regions, but does not depend on the infra-structure.

As regards the complex control systems, they are imposed by the necessity of controlling a depot of vehicles which pass from one track to the other by systems of points, bunched together whilst slowing down etc...

The object of the present invention is to provide an economical continuous transport system which avoids these drawbacks, for serving an urban region for example by public transport.

SUMMARY OF THE INVENTION

A continuous transport system according to the invention comprises at least one main track which is in the form of a loop and is constantly travelling, at least one station located along this track and at least one vehicle able to travel while remaining integral with the point of the track, or on the contrary slowing down momentarily at a station and it is characterised in that each vehicle is composed of a platform and a cabin, a station being composed of at least one looped station track and series of platforms being provided, firstly along the main tracks and secondly along the station tracks to travel with the latter, such that the platforms are located strictly side by side in horizontal projection in each section common to two tracks in order to allow a cabin to pass from one platform to the other, the arrangement being in the form of a system of looped tracks which never intercept each other.

According to an additional feature of the invention, each track is formed by an uninterrupted line of travelling platforms interconnected by mechanical means which compel each platform to remain in a precise given position in the line, these mechanical means comprising, between two consecutive platforms, a mechanical link which is always taut along a length depending on a given mechanical law, the total length of the line always remaining constant.

According to an additional feature of the invention, the conditions which are necessary and adequate for there to be a change of cabins between the platforms of two tracks each having its own law of speed, are as follows:

a. The arrangement of all the platforms of all the tracks of the system have the same timed spacing all the time and at any point, whatever the speeds of these vehicle platforms and their separations;
b. The parallel sections of two tracks along which the exchanges of cabins take place, are synchronous and have the same separation for exchangeable vehicles, i.e., for vehicles belonging to the same category, the timed spacing at a point being defined on a track as the interval of time elapsing between two passages at this point of two consecutive platforms relating to vehicles of the same categories.

According to an additional feature of the invention, the timed spacing is constant if the sum of the windings or unwindings of the links which each connect two consecutive platforms is equal at any time, on the members for controlling the varied zone of deceleration or reacceleration, to the difference of the extreme speed V and v prevailing before and after the passage into the varied zone.

According to an additional feature of the invention, the transport system comprises an arrangement of looped tracks, which never intercept and mesh with each other in the manner of linear gears meshing mechanically with each other and always passing indefinitely through the same cyclic positions, whereas the platform comprised by each vehicle may be any one of the predetermined platforms which each travel on a given track for a given cabin.

According to an additional feature of the invention, the transport system comprises at least two main tracks which are connected by at least one transfer region through which three intermediate tracks also pass, namely:

- a first intermediate track which travels between the two others;
- a second intermediate track which comprises a section common to the first intermediate track located between two sections common to the first main track;
- a third intermediate track, which comprises a section common to the first and second intermediate tracks located between two sections common to the second main track;
- at least two of the intermediate tracks comprising regions of variable speed between each interval of two common sections.

According to one variation of the invention, several circuits are superimposed, which comprise in common at least one looped track on which the timed spacing of two vehicles of different categories could be a whole submultiple of the timed spacing of the other individual tracks, whereas even on this commom looped track, the timed spacing of two consecutive vehicles of the same category conforms with the general law, i.e., conforms with the timed spacing of each of the individual tracks.

According to an additional feature of the invention, the system comprises at least one main track having two sections common to several secondary tracks, the platforms of the main track corresponding successively with a platform of each secondary track in the order of passage in each common section, whereas the respective platforms of the secondary tracks may be out of phase with respect to each other, at least as regards time, from one secondary track to the other, by a fraction of the timed spacing equal to the ratio of the low embarkation speed of the vehicles to the high travelling speed of the main track.

According to an additional feature of the invention, each station track comprises:

- a section AB common to the main track,
- a deceleration section BC,
- a very low speed section CD, in particular for passengers to alight and get into the vehicle,
- a reacceleration section DE,
- a section EF common to the main track,
- a high speed return loop section FA.

According to an additional feature of the invention, on the section EF, the distance between the platforms of the station track is constant and equal to the distance between the platforms of the main track.

According to an additional feature of the invention, the drive chains for the main track and station track are driven in synchronism by pinions meshing with the latter at at least one point of the sections AB and EF.

According to one variation of the invention, the drive chains for the main track and station track are themselves driven by a third driving chain driving the main track over the section AF and the station track over the section FA.

According to an additional feature of the invention, each track comprises at least one continuous rail for guiding and supporting the platforms, as well as at least one chain driven in parallel to the direction of the rails, each platform being connected to one link of the chain.

According to an additional feature of the invention, each station track comprises substantially horizontal sections BE and FA, whereas its section AB is ascending and its section EF descending, these two sections crossing the corresponding substantially horizontal section of the main track, in projection of a vertical plane.

According to an additional feature of the invention each cabin comprises a vertical engagement device for hanging from the platforms such that the transfer of a cabin attached to a platform of the main track to a platform of the station track is possible on the sections AB by the engagement with a platform of the station track accompanied by a slight rise of the cabin causing its disengagement from the platform of the main track, the reverse operation being possible on the sections EF.

According to an additional feature of the invention, each platform is integral with at least one fork open on the upper side, whereas each cabin comprises in its upper part, at least one projection able to engage in the forks by vertical engagement, in order to suspend the cabin from the platforms.

According to a variation of the invention, the platforms of the various tracks, station tracks and main tracks, are provided with means for ensuring almost only the drive and guidance of the cabins which rest, whilst moving forwards, on a path parallel to the runways of the platforms.

According to an additional feature of the invention, each cabin comprises support means constituted by at least two rear wheels able to rotate freely about substantially horizontal axles arranged transversely with respect to the path.

According to an additional feature of the invention, the path is located above a cover in which the platforms travel.

According to an additional feature of the invention, each platform comprises an attachment shaft able to engage in an appropriate housing provided at the front of each cabin, this shaft being able to slide substantially vertically while co-operating with a fixed ramp provided in the cover whose upper part comprises a longitudinal recess opening out in the central part of the path to allow the passage of the shaft.

According to an additional feature of the invention, in each section common to the main track and to a station track, the platforms of these two tracks travel in a common section of cover, side by side, whereas each cabin comprises at least two lower housings intended to co-operate with the shafts of the platform of one and the other track, these shafts also co-operating respectively with various ramps of the cover.

According to an additional feature of the invention, each ramp is located close to the base of the cover, with its useful surface turned upwards, whereas each attachment shaft is integral with a roller which is able to bear on the ramp under the joint effects of gravity and the return force of a spring.

The accompanying drawings, given as a nonlimiting example, will make it easier to understand the features of the invention.

DETAILED DESCRIPTION OF THE INVENTION

Figure 1:
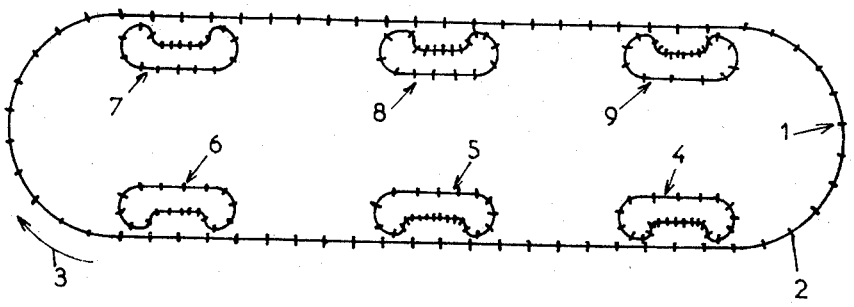
FIG. 1 is a diagrammatic plan view of a continuous transport system according to the invention.

FIG. 1 shows a continuous transport system according to the invention, comprising a main track 1 which is looped, travelling at constant speed and provided at regular intervals with platforms 2 which travel with the latter in the direction indicated by arrow 3. Six stations 4 to 9 are shown along the track 1. These stations are identical and the structure of station 4 will be described in detail with reference to FIG. 2. This station comprises a continuous track 10 which travels in the direction indicated by the arrow 11, tangentially with respect to the track 1. The track 10 comprises:

- a section AB where it is located in a vertical plane parallel to the track 1, and where its travelling speed is constant and equal to that of the track 1;
- a deceleration section BC;
- a section CD with a very low travelling speed;
- a reacceleration section DE;
- a section EF where it is located in a vertical plane parallel to the track 1 and where its travelling speed is constant and equal to that of the track 1;
- a high speed return loop section FA.

Figure 3:
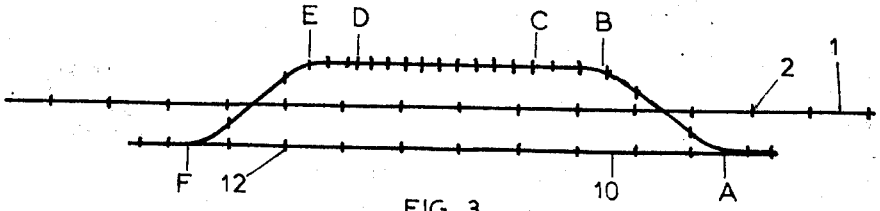
FIG. 3 is a diagrammatic front view in the direction III (FIG. 2), showing the tracks in projection.

The sections BE and FA are located in substantially horizontal planes. On the other hand, the section AB rises and the section EF descends. The front view of FIG. 3 shows partly the track 1, whereof the projection crosses the sections AB and EF.

The track 10 is provided with platforms 12, identical to the platforms 2.

Figure 4:
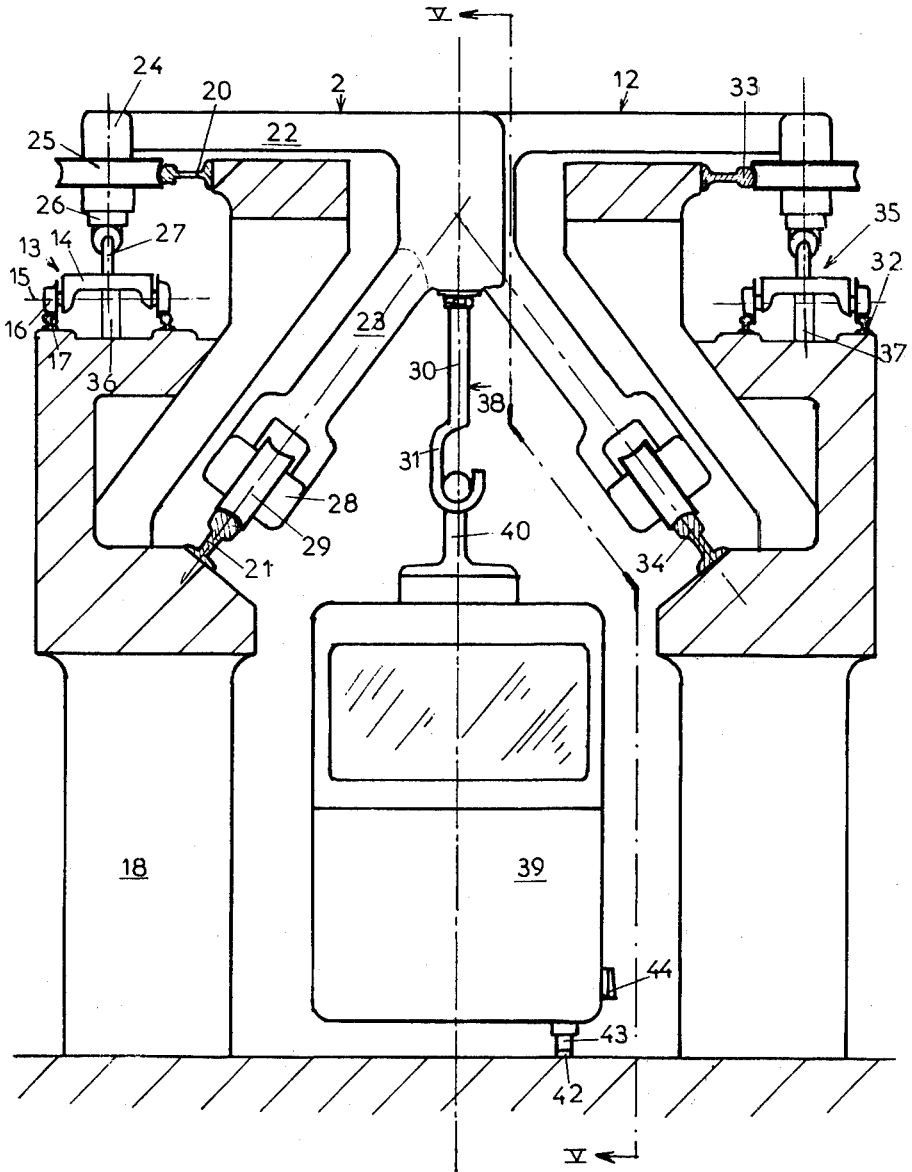
FIG. 4 is a section IV — IV (FIG. 2) showing a cabin in the course of transfer from one track to the other.

FIG. 4 shows in detail a section of the tracks 1 and 10. The track 1 is constituted by a chain 13, whereof the pivot pins 15 of the links 14 are horizontal. Certain of the pins 15 support lateral rollers 16 which roll on two longitudinal parallel rails 17. The rails 17 are secured now and then to supports 18 anchored to the ground 19, thus marking out the path of the track 1. The supports 18 also support an upper horizontal rail 20 and lower oblique rail 21, both parallel to the rails 17. A platform 2 is also shown which is in the form of a "V" with an upper horizontal side 22 and a lower oblique side 23. The free end of the side 22 supports two bearings 24 for mounting two pulleys 25 having a vertical axis, travelling against the rail 20, as well as a flange 26 for securing it to the chain 13. The flange 26 is engaged in another flange 27 integral with one of the links 14.

The lower free end of the side 23 supports two bearings 28 which each guide the rotation of a pulley 29 having an oblique axis, travelling against the rail 21. The platform 2 is also provided with two rods 30 which extend vertically and downwards from the junction of the branches 22 and 23 and whereof the lower end has a fork 31, which is open at the top. The two forks of each platform are aligned parallel to the track 1.

The track 10 has a structure identical to that of the track 1. In FIG. 4, these two tracks appear as symmetrical with respect to the longitudinal vertical plane passing through the rod 30. In fact, the rails 32, 33 and 34 of the track 10 are oblique with respect to the corresponding rails 17, 20 and 21 of the track 1, which are horizontal. In fact, the section plane IV — IV defined on FIG. 2 corresponds to the intersection of the section AB with the track 1, in projection on a vertical plane.

The track 10 also comprises a chain 35, along which are fixed the platforms 12. On the other hand, these platforms are not uniformly spaced. In fact, their spacing is made variable by a method known for example from French Pat. No. 2,236,391 by using a winding of coils, control of bars, or a deformation of the chain 35, such that the platforms 12 are strictly side by side with the platforms 2 in horizontal projection on the sections AB and EF, but have variations of speed described above on the various sections.

Figure 5:
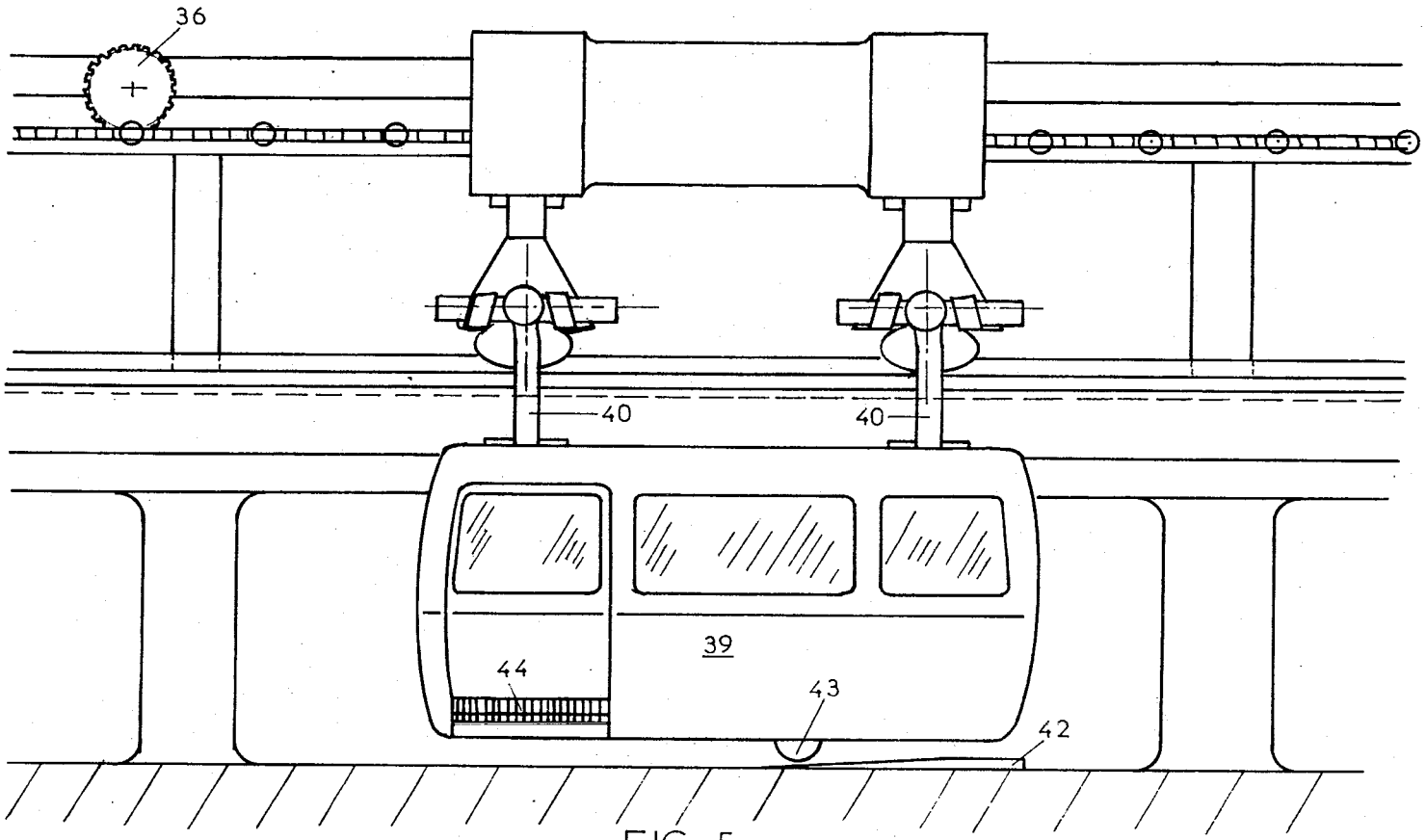
FIG. 5 is a section V — V (FIG. 4).
Figure 6:
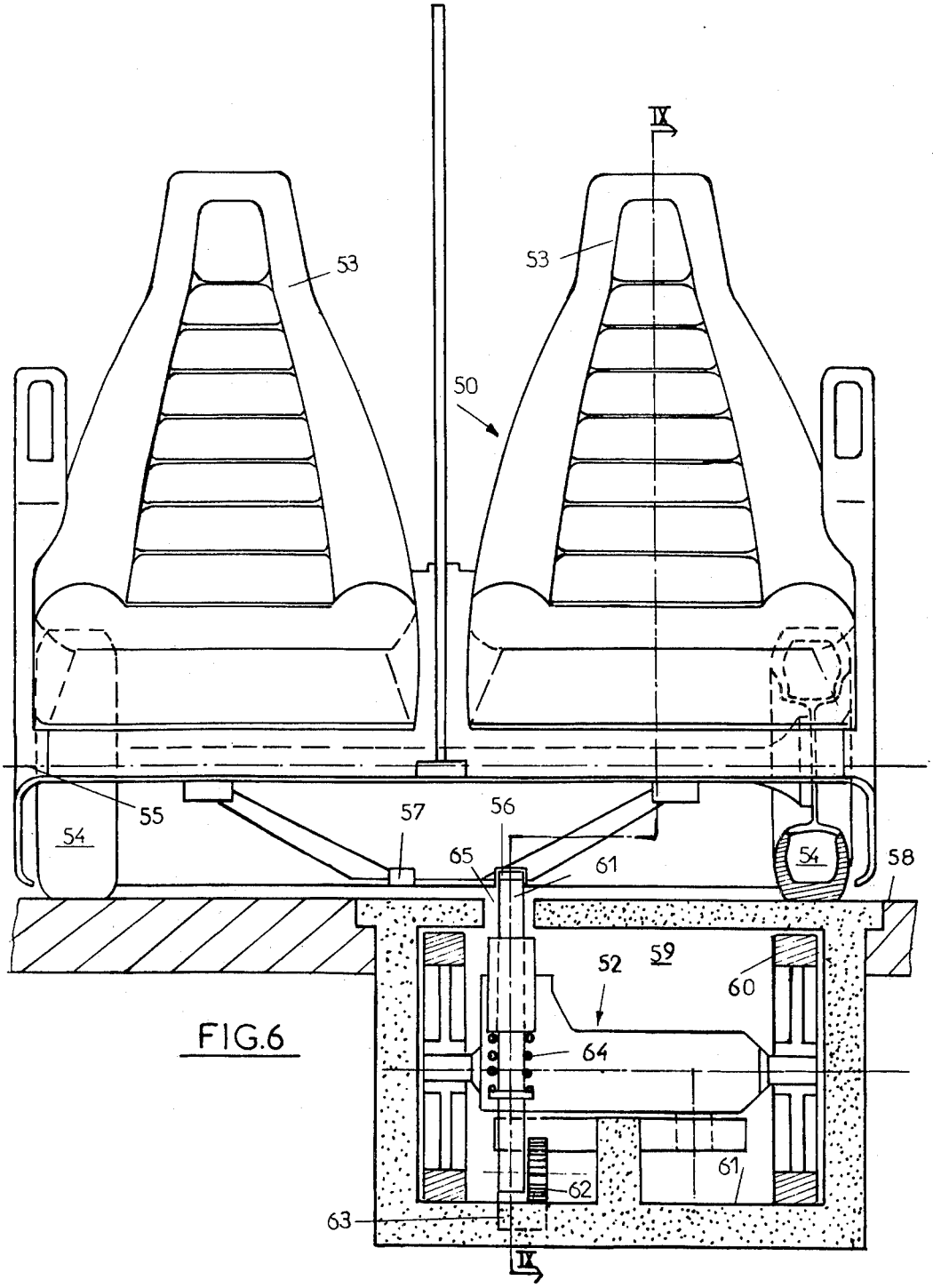
FIG. 6 is a cross-sectional view of a transport vehicle according to one variation of the invention on a main track.
Figure 7:
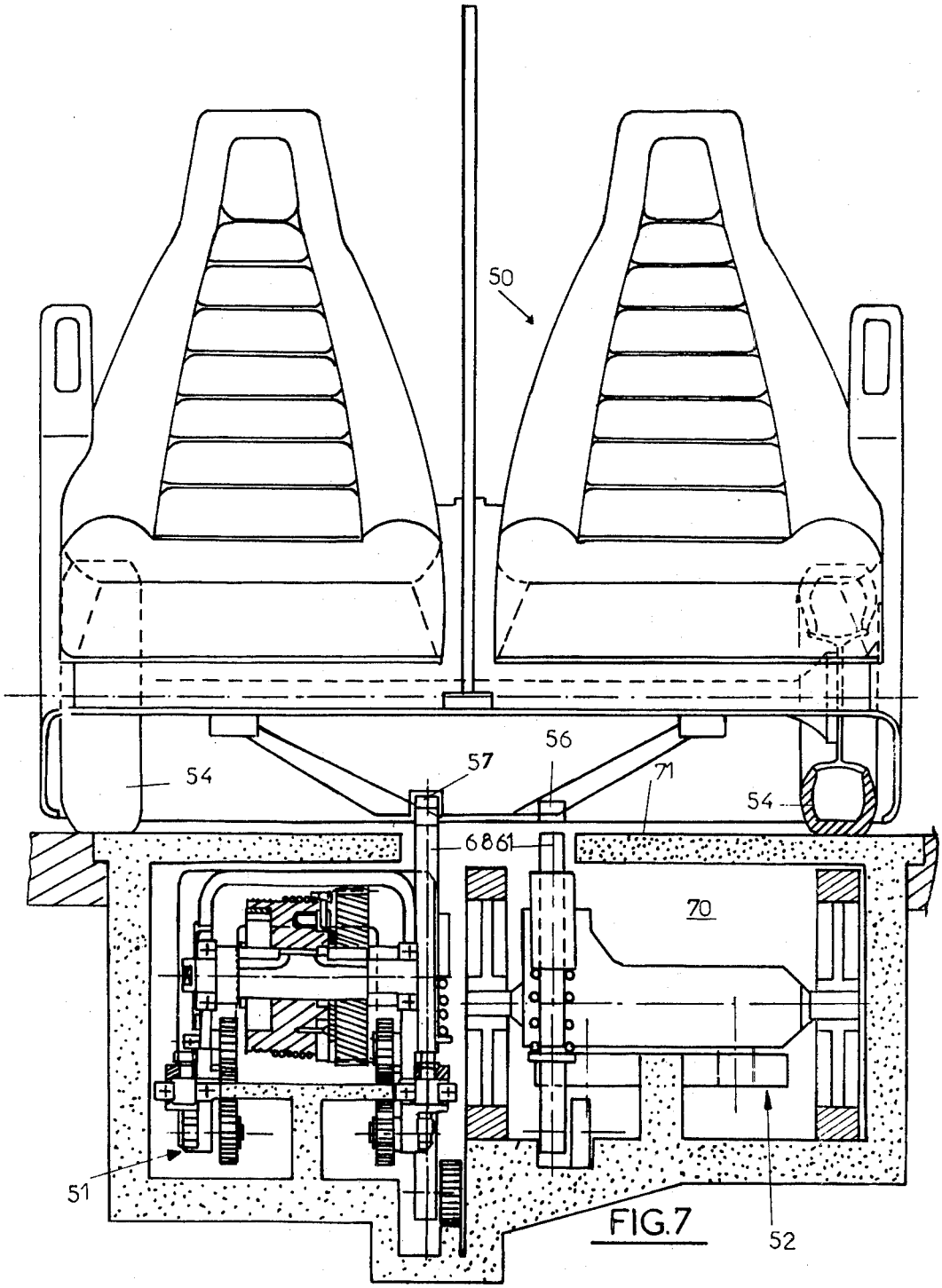
FIG. 7 is a cross-sectional view of this vehicle on a section common to two tracks.
Figure 8:
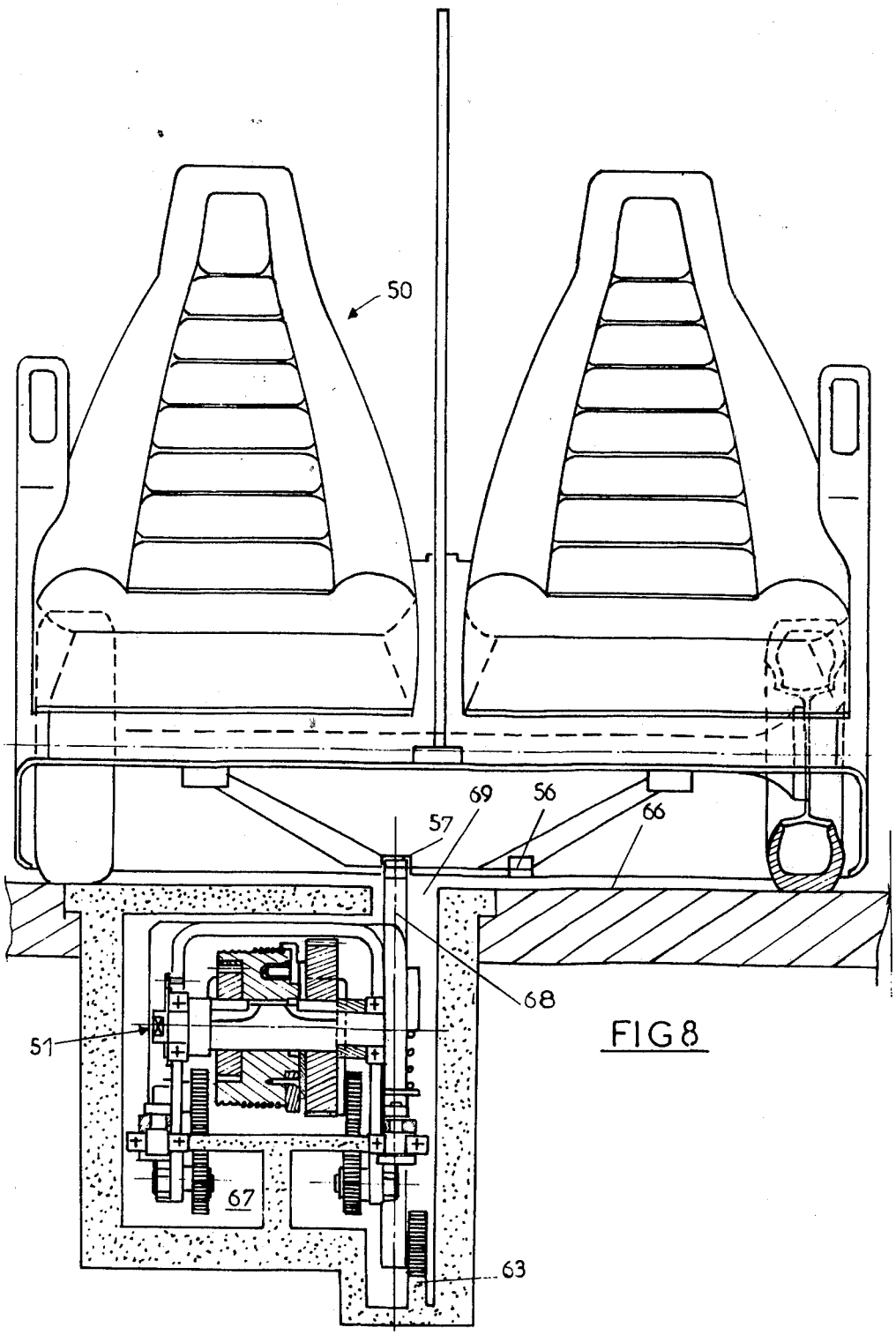
FIG. 8 is a cross-sectional view of this vehicle on a station track.
Figure 9:
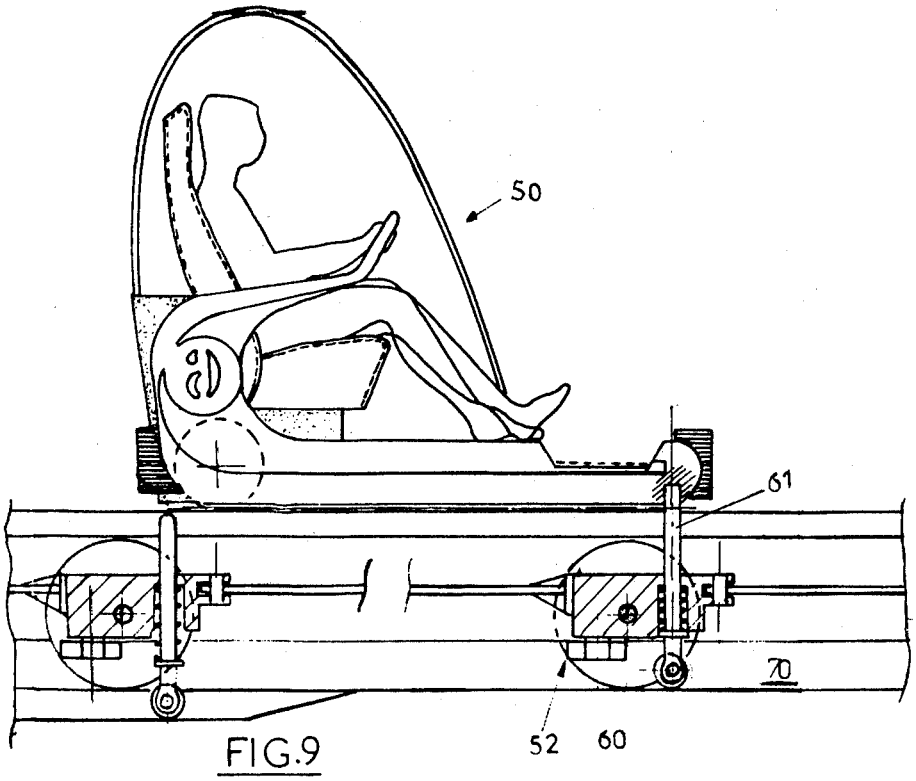
FIG. 9 is a section IX — IX (FIG. 6).

The chains 13 and 35 are driven by means of the pinion 36 which meshes with the former and of the pinion 37 which meshes with the latter along the section AB (FIG. 5). The deceleration of the section BC and acceleration of the section DE are achieved by the system known by the name "Accelerator comprising coils".

The arrangement of the platforms 2 and 12 is in order to prevent interference between the rods 30 of a platform 2 and the rods 38 of a platform 12, located at the side.

To form a vehicle, one requires firstly a platform 2 or 12 and secondly a cabin 39. Each cabin 39 comprises upper projections 40 for engaging in the forks 31. This engagement is maintained by gravity, owing to the inherent weight of the cabin.

The operation is as follows.

The transport system described comprises an entire series of vehicles which travel indefinitely in a looped circuit along the track 1, these vehicles being constituted by a cabin 39 and a platform 2. In the case where a stop at one of the stations 4 to 9 is desired, the transfer of the corresponding cabin takes place by a lateral movement of this cabin in the direction of the track 10. The fork 31 of the platform 12 thus engages under the projection 40 of this cabin, throughout the section AB. Simultaneously, the cabin is disengaged from the fork of the platform 2.

The section CD enables the passengers to alight and ascend. By means of a method similar to that already described, the section EF allows the transfer of the cabin from a platform 12 to a platform 2.

The section FA of the track 10 is a high speed section.

Figure 2:
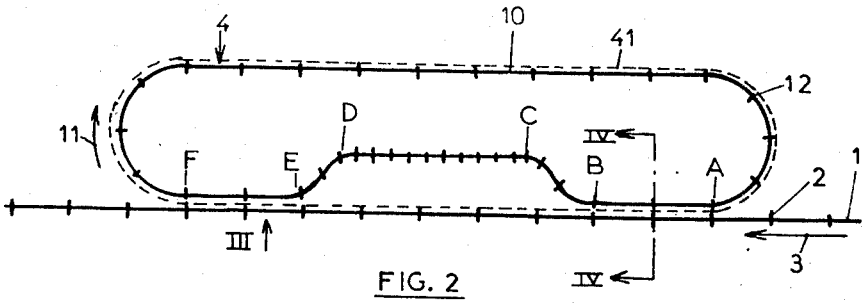
FIG. 2 is a partial view of FIG. 1, intended to show a station track.

FIG. 2 shows a device for driving the two chains 13 and 15 according to a variation of the invention. This device comprises a third chain 41 shown in dotted line. This chain 41 is a driving chain and forms a loop. It travels in the same direction of rotation as the two others, while driving the chain 13 over the section AF and the chain 35 over the section FA.

To increase the comfort of the cabins, a ramp 42 (FIG. 4) is provided, located below the point where the cabins pass along the section CD. This ramp co-operates with a roller 43 of the cabin mounted in order to travel on the ramp as on a cam for controlling the descent and retraction of a retractable staircase 44 according to the known system of combs.

The advantage of the device described resides in the fact that its automation is brought about by mechanical means, without any electronic control or dispatching system. It is clear that this does not exclude the use of electronic systems for detecting accidents or safety systems.

According to another embodiment illustrated in FIGS. 6 to 9, the same cabin 50 is shown, which may be associated either with a platform 51 of a station track (FIGS. 7 and 8) or a platform 52 of the main track (FIGS. 6 and 9), to form a complete vehicle in both cases.

The cabin 50 comprises two seats 53 and two rear wheels 54 which may rotate freely about a transverse axle 55. At the front, the cabin also comprises two lower housings 56 and 57, which are open at the bottom and located side by side.

The main track (FIG. 6) comprises a substantially horizontal path 58 which surmounts a cover 59, inside which the platforms 52 travel.

Each platform 52 is provided with two transverse wheels 60 which travel on the base 59a of the cover 59, whereas this platform has an attachment shaft 61 whose vertical axial translation it guides. The lower end of this attachment shaft 61 supports a roller 62 having a transverse axis, which is able to travel on a fixed ramp 63 integral with the base 59a. Contact between the roller 62 and the ramp 63 is maintained permanently by means of a helical spring 64 which tends to urge the attachment shaft 61 downwards resting on the platform 52.

By sliding upwards, the attachment shaft 61 is able to engage in a housing 56 passing through a central longitudinal recess 65 in the path 58.

The station track (FIG. 8) comprises a substantially horizontal path 66 identical to the path 58 and which surmounts a cover 67 inside which the platforms 51 travel.

Each platform 51 comprises a vertical sliding attachment shaft 68 mounted in a substantially identical manner to the attachment shaft 61 for engaging in a housing 57 in the cabin 50, by passing through a central longitudinal recess 69 in the path 66.

In each section common to two tracks (FIG. 7), platforms 51 and 52 travel side by side, at the same speed, in a double cover 70 which is surmounted by a path 71 identical to the paths 58 and 66.

The transport system illustrated in FIGS. 6 to 9 operates in the following manner.

The cabin 50 is supported at three points. The first two points are the points of contact of the rear wheels 54 on one of the paths. The third point is constituted by the point of contact of the attachment shaft 61 in the housing 56, or by the point of contact of the attachment shaft 68 in the housing 57, depending on whether one or the other of the shafts is engaged in its respective housing.

The cabin 50, on the one hand and the platforms 51 and 52 on the other hand, thus have their own runways, whereas the platforms 51 and 52 ensure the pulling and guiding of the cabin while supporting the front thereof.

When a cabin 50 travels along the main track on the path 58 (FIG. 6), it is thus supported at the front by the attachment shaft 61 engaged in a housing 56 by means of an appropriate shape of the ramp 63, as a bearing.

When the same cabin travels alongs a station track (FIG. 8) on the path 66, it is supported at the front by an attachment shaft 68 engaged in a housing 57 by means of a bearing of the corresponding ramp of the cover 67.

When the same cabin, travelling along a station track, reaches a section common to this station track and to the main track, on the path 71 (FIG. 7), the ramps are provided such that the attachment shaft 61 is raised progressively in order to engage in a housing 56, whereas subsequently the attachment shaft 68 is lowered to allow the engagement of the shaft 61. The cabin 50 is thus transferred from the platform 51 to the platform 52.

When the same cabin, travelling on the main track, reaches a section common to a station track and this main track, the reverse procedure takes place, the cabin 50 neither being supported, nor suspended, but pulled by a platform on its own runway.

According to other variations of the invention, FIGS. 10 to 20 show various continuous transport systems which satisfy the following two conditions:

a. the arrangement of vehicles of all the tracks of the system have, at the same time and at the same point, the same timed spacing, whatever the speed of these vehicles and their separation with respect to adjacent vehicles,
b. the parallel sections of two tracks along which the cabins are exchanged, are synchronous and have the same spacing for exchangeable vehicles, i.e., for vehicles belonging to the same category.

These two conditions are necessary and sufficient to allow an exchange of cabins between the platforms of two tracks each having its own law of speed.

In addition, the timed spacing is constant if, at any instant, the sum of the windings or unwindings of the ties of the coils belonging to the platforms of the varied zone is equal to the difference of the extreme speeds V and $v$ for this varied zone. As mentioned above, the timed spacing designates, at one point of a track, the interval of time elapsing between two consecutive vehicles belonging to the same category passing this point. A varied zone is an acceleration zone or decleration zone.

Figure 10:
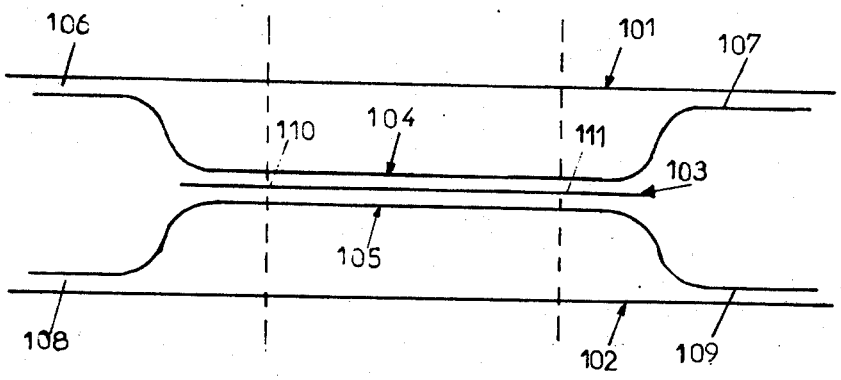
FIG. 10 is a diagrammatic plan view of a transfer region of two main tracks, according to another variation of the invention.

FIG. 10 shows a transfer zone for cabins between a main track 101 and another main track 102. In this transfer zone, an intermediate track is provided, which travels at a constant speed between the tracks 101 and 102 and tracks 104, 105 in order to joint the tracks 101, 103, then 102, 103 respectively. These tracks have only been illustrated partially.

At 106 and 107, the tracks 101 and 104 have two common sections where the cabins move side by side in synchronism. The tracks 102 and 105 also have two common sections 108 and 109 of the same type. Between the points 110 and 111, the tracks 103, 104 and 105 have a common section which is always of the same type.

The tracks 104 and 105 have appropriate varied zones outside the common sections.

Owing to the presence of intermediate tracks 103, 104 and 105, it is thus possible to transfer cabins from the track 101 to the track 102, passing from 106 to 109, or on the contrary from the track 102 to the track 101, passing from 108 to 107. Thus, a cabin on the track 101 picked up at 106 by the track 104 is transferred by the latter to the track 103 where the track 105 in turn picks up the latter in order to transfer it at 109 to the platform of the track 102, which has picked up its cabin at 108.

Figure 11:
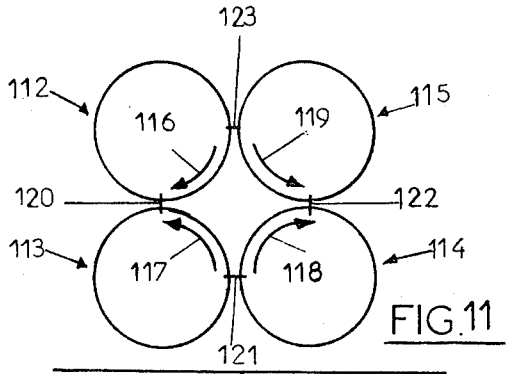
FIG. 11 is a diagrammatic plan view of a transport system according to another variation of the invention, comprising four main tracks.

According to another variation of the invention, FIG. 11 shows a continuous transport system comprising four main tracks 112, 113, 114 and 115, on which the platforms travel in the direction indicated by the respective arrows 116, 117, 118 and 119. Each main track may have all the desired secondary deceleration tracks which are not shown here.

The tracks 112 and 113 comprise therebetween a zone of proximity 120, which is identical to the transfer zone illustrated in detail in FIG. 10, for the main tracks 101 and 102. In the same way, the tracks 113–114, 114–115 and 115–112 have respective transfer zones 121, 122 and 123.

The arrangement of tracks of this circuit is similar to a clockwork mechanism whereof all the parts, formed by types of linear gears, mesh mechanically one with the other, always passing indefinitely through the same cyclic arrangements. Each vehicle always comprises, on the one hand, a cabin and on the other hand a platform integral with a given track, but the vehicle may change its platform on the occasion of each transfer. The tracks mesh one with the other with a common and constant timed spacing. This timed spacing fulfills the function of the modulus in conventional gear trains.

Figure 12:
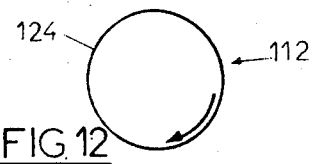
FIGS. 12 to 19 are partial views of FIG. 11, illustrating the operation of the transport system of FIG. 11.
Figure 13:
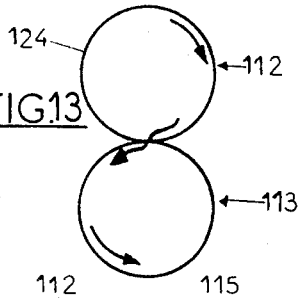
Figure 14:
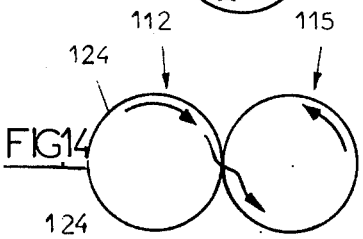
Figure 15:
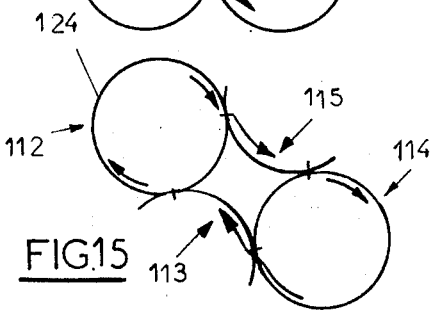
Figure 16:
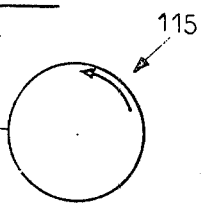
Figure 17:
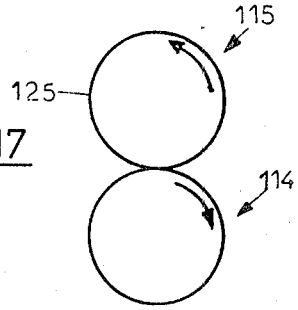
Figure 18:
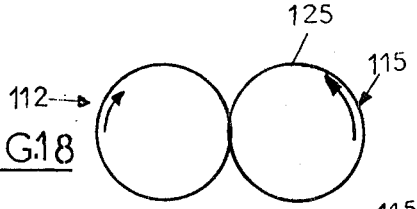
Figure 19:
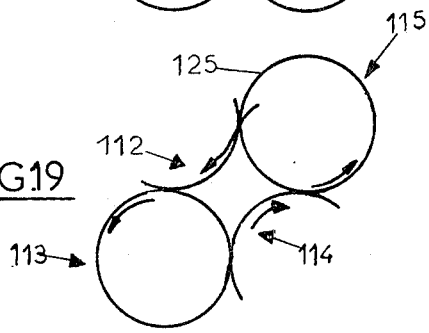

Taking into consideration the transfer possibilities described with reference to the tracks 101 and 102, it will be seen that a cabin 124 travelling at a given instant on the track 112 could make at will:

- either the journey shown in FIG. 12, by remaining simply on the track 112;
- or the journey illustrated in FIG. 13, by travelling between the tracks 112 and 113;
- or the journey illustrated in FIG. 14, by travelling between the tracks 112 and 115;
- or the journey illustrated in FIG. 15, by travelling between the tracks 112 and 114 and in so doing using a portion of the track 113 and 115.

A cabin 125 travelling at any given instant on the track 115 could likewise make the various journeys illustrated in FIGS. 16 to 19 and so on.

Figure 21:
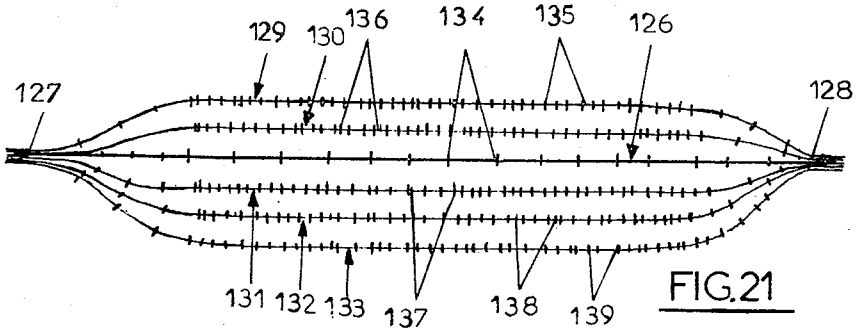
FIGS. 21 to 23 are partial diagrammatic plan views of continuous transport systems according to other variations of the invention.

According to another variation of the invention, FIG. 21 shows a main track 126 which comprises at 127 and 128, two sections common to five secondary tracks 129, 130, 131, 132 and 133. The main track 126 is provided with platforms 134. The secondary tracks 129 to 133 are provided with respective platforms 135 to 139, which are out of phase one with respect to the other in time, from one track to the other, by a fraction of the timed spacing equal to the ratio ($v/V$,) i.e., to the ratio of the low embarkation speed of the vehicles to the high travelling speed of the main track 126. The successive platforms of the main track 126, when they are taken in order, are exchangeable or correspond successively to a platform of the track 129, to a platform of the track 130, to a platform of the track 131 and so on.

Figure 20:
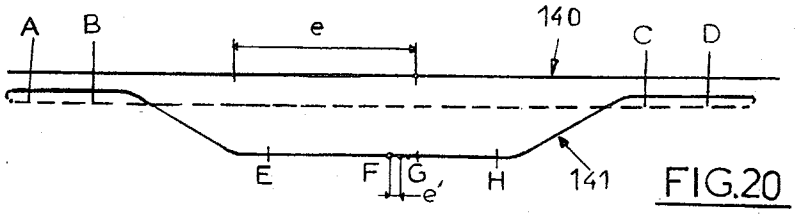
FIG. 20 is a diagrammatic partial plan view of a continuous transport system, in a region common to a main track and a station track.

To provide a better understanding of the advantage provided by this arrangement, reference will be made to FIG. 20, which shows a main track 140 and a secondary track 141, whereof the return looped portion is shown in broken line. The references adopted to designate the sections are the same as those of FIGS. 2 and 3. Thus, AB and EF are the synchronous cabin transfer sections; BC is a deceleration zone, DE is a reacceleration zone and CD is the embarkation zone.

From C to D, the vehicles travel at the low embarkation speed $v$, whereas on the main line they travel at the high speed V. The relative separation of two consecutive platforms is $e$ on the track 140 and $e'$ on the track 141. The relationship ($e/e'$), and ($V/v$) are equal. On the other hand the vehicles travel through $e$ on one track and $e'$ on the other in a period of time equal to the timed spacing. It is thus clear that the load capacity of the track 140 is limited by the length $e'$ and that the vehicles which could be located on the track 140 in an interval ($e - e'$) represent lost potential capacity.

In fact, all along a varied zone, the separation varies depending on the speed such that in the zone where the vehicles travel at the low speed $v$, the separation should be such that each vehicle finds its place in the line, whereas when these vehicles, having once reaccelerated, are travelling at the speed V, either on one track or the other, their separation is multiplied according to the ratio ($V/v$) of the extreme speeds.

Owing to the arrangement of FIG. 21, the separations of successive platforms 34 belonging to the same group, i.e., which are exchangeable with platforms of one of the secondary tracks, always remain in a ratio of ($V/v$) of the separations of platforms of this secondary track. On the other hand, the timed spacing of the platforms 34 considered without distinguishing groups, on the track 126 is equal to 1/5 of the timed spacing common to all the platforms of the secondary tracks 129 to 133.

One thus achieves a coherent distribution of the platforms and vehicles, which makes it possible to achieve the maximum transportation capacity of the system.

Figure 22:
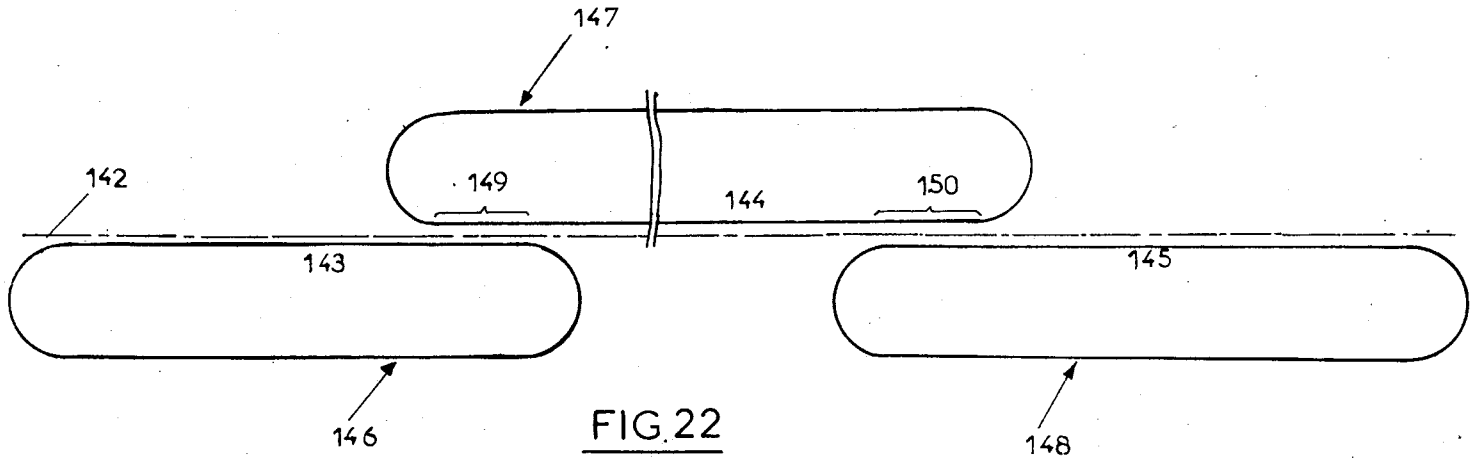

According to another variation illustrated in FIG. 22, the transfers of cabins from one platform to the other take place in series, in the same manner that they take place in shunt, as will be seen. This figure partly shows a track 142 comprising several sections such as the sections 143, 144, 145 etc., each section belongs to a looped track, or respectively to the tracks 146, 147 and 148 and two consecutive tracks have a common section. The tracks 146 and 147 thus have the common section 149, the tracks 147 and 148 have the common section 150 and so on. Each time they pass on to a common section, the cabins are transferred from one track to the following track such that no cabin ever follows the looped return of these tracks.

The cabin speeds are not the same on two common sections of the same track and each track thus comprises either an acceleration section, or a deceleration section, then forms a loop laterally or below.

This may be the case of the track 146 for example, which would divide the entry speed of the cabins by N and which would then allow the cabins to pass at 149 onto the track 147 in order that the latter are once more decelerated N times. By positioning several successive tracks, it is possible to obtain decelerations as great as desired.

Figure 23:
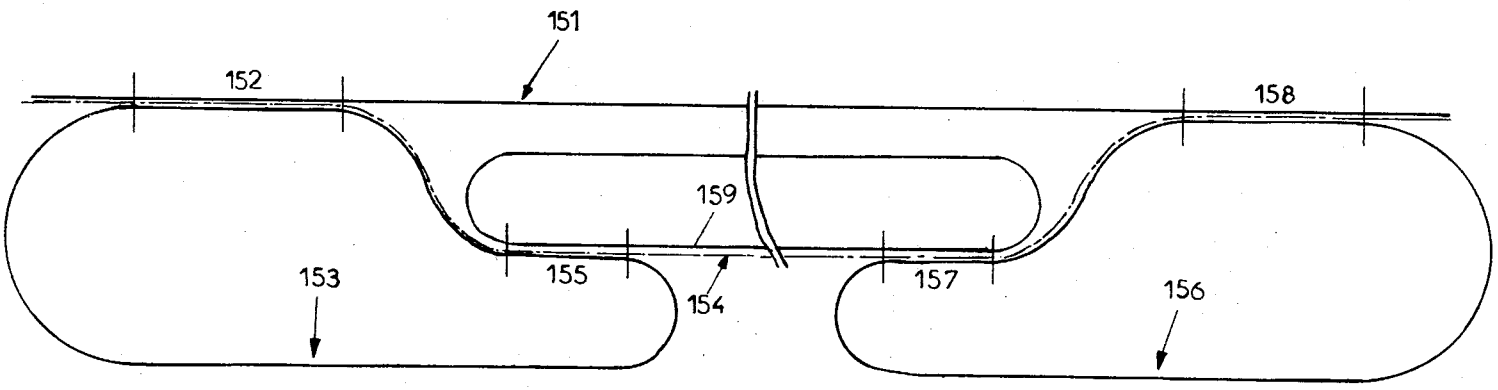

According to the variation illustrated in FIG. 23, a high speed main track 151 comprises a common section 152 along which the cabins are picked up by a secondary track 153, in order to be subsequently picked up by another secondary track 154, along a common section 155, after which the cabins are picked up by a new secondary track 156 along a common section 157 in order to be finally replaced along a second 158 on the main track 151.

Between the sections 152 and 155, each cabin is decelerated N times, in order to be once more decelerated N times between the sections 155 and a disembarkation or embarkation point 159 provided on the track 154. The cabin is then reaccelerated N times between the point 159 and the section 157 and once more N times between the sections 157 and 158.

Such an arrangement of pick-ups makes it possible to obtain a ratio $N^2$ between the speed of the main track and the embarkation speed at 159. By increasing the number of intermediate tracks, it is possible to obtain a ratio $N^n$ as large as desired (if n is the number of intermediate tracks between the speed of the main track and the speed of the disembarkation or embarkation point).

I claim:

1. A continuous transport system comprising:
at least one main looped track;
a plurality of vehicles, each said vehicle including a platform and a removable cabin;
said main track having a plurality of said platforms secured thereto at regular intervals and being adapted to convey said platforms at a constant speed;
at least one looped disembarkation and embarkation station track having a portion thereof substantially parallel to a section of said main track;
said station track having a plurality of said platforms secured thereto and being adapted to convey said platforms therealong at a varying speed;
wherein each said platform disposed on said portion of said station track which is substantially parallel to said section of said main track is conveyed in a side-by-side horizontal projection relationship and at an equal speed with respect to a corresponding platform disposed on said section of said main track;
each of said removable cabins being adapted to be transferred between a platform disposed on said portion of said station track and a corresponding platform disposed on said section of said main track; and
wherein said station track is adapted to never intercept in the same plane with said main track.

2. A transport system according to claim 1, wherein:
each track is formed by an uninterrupted line of said travelling platforms;
said platforms are connected by mechanical means for compelling each platform to remain in a given precise position of said line; and
said mechanical means comprises a mechanical link between two consecutive platforms which remains taut along a given length to permit the total length of said line to always remain constant.

3. A transport system according to claim 1 characterized in that:
a. the arrangement of all the platforms of all the tracks of the system have, all the time and at any point, the same timed spacing, whatever the speeds of these platforms and their relative separations; and
b. the parallel sections of two tracks along which the cabin exchanges take place are synchronous and have the same separation for exchangeable vehicles, the timed spacing at a point being defined on a track as the interval of time which elapses between the passage of two consecutive platforms relating to vehicles of the same categories, past this point.

4. A system according to claim 3, characterized in that the time spacing is constant when the sum of windings or unwindings of the links which each connect two consecutive platforms is equal at any time, on the control members of the varied zone of deceleration or reacceleration, to the difference of the extreme speeds before and after the passage in the varied zone.

5. A transport system according to claim 1, characterized in that it comprises an arrangement of looped tracks, which never intercept and which mesh one with the other in the manner of linear gears engaging mechanically one with the other whilst always passing indefinitely through the same cyclic positions, whereas the platform comprised by each vehicle may be any one of the predetermined platforms which each travel on a given track for a given cabin.

6. A transport system according to claim 1, characterized in that it comprises at least two main tracks connected to each other by at least one transfer zone through which three intermediate tracks also pass, said three intermediate tracks comprising:
- a first intermediate track which travels between the two others;
- a second intermediate track which comprises a section common to the first intermediate track located between two sections common to the first main track; and
- a third intermediate track which comprises a section common to the first and the second intermediate tracks located between two sections common to the second main track, at least two of the three intermediate tracks comprising the varied speed zones between each interval of two common sections.

7. A transport system according to claim 1, characterized in that several circuits are superimposed which comprise in common, at least one looped track, on which the timed spacing of two vehicles of different categories are adapted to be a whole submultiple of the timed spacing of the other individual tracks, whereas even on said common looped track, timed spacing of two consecutive vehicles of the same category conforms to the timed spacing of each of the individual tracks.

8. A transport system according to claim 7, characterized in that it comprises at least one main track having two sections common to several secondary tracks, the platforms of said main track corresponding successively with a platform of each secondary track in the order of passage in each common section, whereas the respective platforms of the secondary tracks are out of phase one with respect to the other as regards time, from one secondary track to the other, by a fraction of the timed spacing equal to the ratio of the low embarkation speed of said vehicles to the high travelling speed of said main track.

9. A transport system according to claim 1, characterized in that it comprises several looped tracks arranged in series, each comprising:
two sections common to two other looped tracks;
a trajectory for the cabins, located between the two common sections; and
a looped return path, along which the cabins do not travel, each cabin successively covering the trajectories reserved for the latter on these looped tracks, passing from one track to the other.

10. A transport system according to claim 9, characterized in that certain of said tracks comprise an acceleration or deceleration portion along said trajectory reserved for said cabins, whereas said cabins do not travel at the same speed on the two common sections of said tracks, to permit several tracks being placed in series all comprising such an acceleration section, or all comprising such a decleration section, to accelerate or decelerate the same cabin several times in succession.

11. A transport system according to claim 1, characterized in that each station track comprises at least:
- a section AB common to a main track;

- a decleration section BC;
- a very low speed section CD, particularly to allow passengers to get in and out of the vehicles;
- a reacceleration section DE;
- section DS common to the main track; and
- a high speed looped return section FA.

12. A transport system according to claim 11, characterized in that on the section AB, the distance between the platforms of the station track is constant and equal to the distance of the platforms of the main track.

13. A transport system according to claim 12, characterized in that chains for driving said main track and station track are driven in synchronism by pinions meshing with the latter at at least one point of said sections AB and EF.

14. A transport system according to claim 12 characterized in that said chains for driving said main track and station track are themselves driven by a third driving chain driving said main track on said section AF and said station track on said section FA.

15. A transport system according to claim 11, characterized in that said cabin is suspended from said platform.

16. A transport system according to claim 11, characterized in that each track comprises at least one continuous rail for guiding and supporting said platforms, and at least one chain driven in parallel to the direction of said rails, each platform being connected to one link of said chain.

17. A transport system according to claim 11, characterized in that each station track comprises sections BE and FA which are substantially horizontal, whereas the section AB ascends and section EF descends, these two sections being adapted to cross the substantially horizontal corresponding section of said main track, in projection on a vertical plane.

18. A transport system according to claim 17, characterized in that each cabin comprises a vertical engagement device which is suspended from said platforms such that the transfer of a cabin attached to a platform of said main track to a platform of said station track is permitted on said section AB by engagement with a platform of said station track and a slight rise of said cabin causing disengagement thereof from the platform of said main track, the reverse operation being permitted on said sections EF.

19. A transport system according to claim 18, characterized in that each platform is integral with a fork open at the top, whereas each cabin comprises, on the upper part thereof, at least one projection adapted to engage in said fork by vertical engagement, to suspend said cabin from said platforms.

20. A transport system according to claim 1, characterized in that said cabin is supported by said platform.

21. A transport system according to claim 1, characterized in that said cabin is provided with its own running means and its own runway independent of those of said platform, adapted to guide, pull or push said cabin.

22. A transport system according to claim 21, characterized in that said platforms of the different tracks are provided with means for ensuring almost solely the drive and guidance of said cabin which bear on a smooth path without points and without guide means other than its means for joining it to said platforms.

23. A transport system according to claim 22, characterized in that each cabin comprises support means constituted by at least two rear wheels adapted to rotate about substantially horizontal axles arranged transversely with respect to the path.

24. A transport system according to claim 22, characterized in that said path is located above a cover in which said platforms travel.

25. A transport system according to claim 24, characterized in that each platform comprises an attachment shaft adapted to engage in an appropriate housing provided at the front of each cabin, said shaft being adapted to slide substantially vertically cooperating with a ramp provided in said cover, whereof the upper part comprises a longitudinal recess opening out in the central part of the path to allow the passage of the shaft.

26. A transport system according to claim 24, characterized in that in each section common to the main track and to a station track, the platforms of these two tracks are adapted to travel in a common section of cover side by side, whereas each cabin comprises at least two lower housings intended to cooperate with the platforms and platform shafts of one and the other track.

27. A transport system according to claim 26, characterized in that each ramp is located close to the bottom of said cover, with its useful surface turned upwards, whereas each attachment shaft is integral with a roller which is adapted to rest on said ramp under the joint effects of gravity and the return force of a spring.

* * * * *